US011718440B2

(12) United States Patent
Fournier et al.

(10) Patent No.: US 11,718,440 B2
(45) Date of Patent: Aug. 8, 2023

(54) WINE BOTTLE WITH CORK RETAINER AND RE-USE FEATURES

(71) Applicant: Lecavalier Cellars LLC, Penryn, CA (US)

(72) Inventors: Michel M. Fournier, Granite Bay, CA (US); Evan Mackenzie, Auburn, CA (US)

(73) Assignee: Lecavalier Cellars LLC, Penryn, CA (US)

( * ) Notice: Subject to any disclaimer, the term of this patent is extended or adjusted under 35 U.S.C. 154(b) by 0 days.

(21) Appl. No.: 17/409,030

(22) Filed: Aug. 23, 2021

(65) Prior Publication Data

US 2022/0055786 A1 Feb. 24, 2022

Related U.S. Application Data

(60) Provisional application No. 63/069,328, filed on Aug. 24, 2020.

(51) Int. Cl.
*B65D 1/02* (2006.01)
*B65D 41/62* (2006.01)
(Continued)

(52) U.S. Cl.
CPC ..... *B65D 1/0276* (2013.01); *B65D 23/0842* (2013.01); *B65D 39/00* (2013.01);
(Continued)

(58) Field of Classification Search
CPC ..... B65D 1/0261; B65D 1/0276; B65D 23/0842; B65D 39/00; B65D 39/0005;
(Continued)

(56) References Cited

U.S. PATENT DOCUMENTS 67,303 A 7/1867 Honrath
279,216 A * 6/1883 Berlien ..... B65D 1/04 40/310
(Continued)

FOREIGN PATENT DOCUMENTS

FR 2761663 10/1998
GB 307049 10/1929
(Continued)

OTHER PUBLICATIONS

Antique (1910) Ball Ketchup-Style Clear Octagonal Glass Bottle. 9.5" Tall L-9112; Aug. 4, 2020; www.ebay.com/itm/224105556110.

*Primary Examiner* — Chun Hoi Cheung
*Assistant Examiner* — Brijesh V. Patel
(74) *Attorney, Agent, or Firm* — Heisler & Associates

(57) ABSTRACT

A wine bottle is provided with a punt at a lower end which includes a cork retainer therein. A cork can thus be stored within the cork retainer. In one embodiment, the cork retainer includes two retainer surfaces which are opposing each other horizontally, and spaced apart by a length similar to opposing portions of the cork to allow the cork to fit tightly between these retainer surfaces. Space above the retainer surfaces can hold a foil wrap with the cork within the cork retainer and holding the foil wrap in place. Full re-use of the bottle is thus facilitated. In one embodiment, the bottle has an octagonal shape so that multiple bottles can be shipped together and placed adjacent each other with flat surfaces distributing loads therebetween, without forces concentrated at points thereof, and to keep the bottles in good shape for washing, refilling and re-use.

8 Claims, 4 Drawing Sheets

(51) Int. Cl.
*B65D 81/127* (2006.01)
*B65D 39/00* (2006.01)
*B65D 23/08* (2006.01)

(52) U.S. Cl.
CPC ..... *B65D 41/62* (2013.01); *B65D 81/127* (2013.01); *B65D 2203/02* (2013.01)

(58) Field of Classification Search
CPC .. B65D 41/62; B65D 81/127; B65D 2203/02; B65D 2203/12
USPC ..... 215/6, 10, 387, 390, 382, 11.6, 2; 220/23.83, 23.4, 379, 212, 669, 631; D9/516, 559, 553, 520
See application file for complete search history.

(56) References Cited

U.S. PATENT DOCUMENTS 1,289,218 A * 12/1918 Maiden ..... B65D 1/0276 40/310
1,595,040 A * 8/1926 Voss ..... B65D 1/06 215/382
D100,744 S * 8/1936 Strouse ..... D9/555
D110,034 S * 6/1938 Reynolds ..... D9/546
D141,023 S * 4/1945 Kunett ..... D9/563
2,374,092 A * 4/1945 Glaser ..... B65D 23/12 206/217
D152,875 S * 3/1949 Frame ..... D9/542
2,779,472 A * 1/1957 Febbraro ..... B65D 1/40 215/373
D191,641 S * 10/1961 Du Pree ..... D9/559
3,563,408 A * 2/1971 Bijvoet ..... B65D 7/02 D7/523
3,590,989 A * 7/1971 Wittwer ..... B65D 21/0237 206/568
4,040,538 A * 8/1977 Gerson ..... A47G 19/14 220/500
D258,570 S * 3/1981 Pettengill ..... D7/615
D266,310 S * 9/1982 Fidler ..... D9/556
D284,923 S * 8/1986 Ritman ..... D7/531
4,798,300 A * 1/1989 Ghosh ..... B65D 1/0269 206/508
5,033,232 A * 7/1991 Vaughn ..... A01G 9/02 47/72
5,050,757 A * 9/1991 Hidding ..... B65D 21/0237 215/383
5,065,875 A * 11/1991 Balavich ..... B65D 21/0237 215/10
5,172,460 A 12/1992 Womack
5,201,431 A 4/1993 Berger
5,211,299 A * 5/1993 Manfredonia ..... A61J 11/008 215/11.1
D337,522 S * 7/1993 Kingsbury ..... D9/559
5,244,106 A 9/1993 Takacs
5,316,398 A * 5/1994 Chandaria ..... B65D 21/0237 132/297
D367,613 S * 3/1996 Weiler ..... D9/520
D391,492 S * 3/1998 Pang ..... D9/538
D391,493 S * 3/1998 Panella ..... D9/571
6,073,757 A * 6/2000 Kornick ..... B65D 21/0237 220/729
6,131,755 A 10/2000 Soyka, Jr.
D470,058 S * 2/2003 Bryant ..... D9/572
7,172,088 B2 * 2/2007 McDade ..... B65F 1/04 220/908.1
7,357,265 B2 * 4/2008 Zoller ..... B65D 23/14 40/406
D580,271 S * 11/2008 Tsai ..... D9/542
D600,122 S * 9/2009 Strasser ..... D9/559
D607,340 S * 1/2010 Klis ..... D9/453
D627,234 S * 11/2010 Hanak ..... D9/668
D638,717 S * 5/2011 Schulman ..... D9/542
8,034,281 B2 * 10/2011 Lowance ..... B65D 77/0493 264/513
8,047,390 B2 * 11/2011 Strasser ..... B65D 1/0223 215/381
8,814,216 B2 8/2014 Estep
D745,406 S * 12/2015 Lovegrove ..... D9/520
D778,726 S * 2/2017 Morazzoni ..... D9/500
10,384,831 B2 * 8/2019 Vlahakis ..... B65D 1/0246
2002/0040883 A1 * 4/2002 Ciesla ..... B65D 1/0261 206/217
2006/0249471 A1 11/2006 Leposavic
2008/0142466 A1 * 6/2008 Balitski ..... B65D 23/12 215/6
2009/0014407 A1 1/2009 Strasser
2011/0017699 A1 1/2011 Solano
2014/0183078 A1 7/2014 Newton
2019/0092527 A1 3/2019 Giuili

FOREIGN PATENT DOCUMENTS

KR 20-2012-0001331 2/2012
WO WO 2004/003875 1/2004

* cited by examiner

WINE BOTTLE WITH CORK RETAINER AND RE-USE FEATURES

CROSS-REFERENCE TO RELATED APPLICATIONS

This application claims benefit under Title 35, United States Code § 119(e) of U.S. Provisional Application No. 63/069,328 filed on Aug. 24, 2020.

FIELD OF THE INVENTION

The following invention relates to wine bottles and similar liquid holding containers. More particularly, this invention relates to wine bottles and similar bottles which include structures thereon for holding a cork, other than at an opening into an interior of the bottle, and especially within a punt at a lower end of the bottle.

BACKGROUND OF THE INVENTION

Wine has been stored in glass bottles for many centuries. The basic structure of the bottle has not changed significantly even over this exceptionally long time. Such bottles include a neck at an upper end of the bottle surrounding an opening into an interior. The neck transitions into a shoulder where the bottle widens to a larger diameter as the bottle extends down at a body portion down to a heel at a lower end thereof. Most bottles include a punt in the exterior lower surface of the bottle, which extends up into a space above the heel. The punt ensures that the bottle can stand on a horizontal underlying surface, even if that surface is uneven, without the bottle being particularly wobbly. The punt can also be oversized to increase an apparent volume of the overall bottle, or to otherwise provide a most aesthetic configuration for the bottle. In some instances, a neck of a bottle can extend up into a punt of another bottle, so that vertical stacking of bottles within some surrounding structure can to some extent to be facilitated. However, the space within the punt of known prior bottles is generally an unused space.

Corks have existed for at least as long as there have been bottles. Typical corks are made from a particular type of oak tree (*Quercus suber*) which has desirable density and resiliency characteristics, as well as a small amount of porosity, to be ideal for storage of wine. The cork is slightly oversized relative to the opening into the neck of the bottle, so that the cork has a friction fit when it is stuffed into the neck of the bottle. The bottle can then be stored on its side, or a variety of other orientations without concern that contents of the bottle will leak out. It is known in more recent times to provide corks formed of synthetic materials. These synthetic materials, typically including polymeric hydrocarbon materials are generally constructed to mimic characteristics of natural corks, with similar resilience, strength and porosity. With this invention, the term "cork" refers to both natural and synthetic items, unless specified in more detail.

In the prior art, cork utilization begins with the bottling of the wine. The wine is placed within the bottles (typically new bottles which have not been used before) and then a new cork is fitted into the opening in the neck of the bottle to close off the bottle. The wine can then be aged for a variety of different amounts of time, before it is delivered to a customer. Such a delivery can be through stores or other merchandisers, or can involve direct sales and transportation via wine bottle containing shipping packages, directly to the consumer. The consumer will then store the wine until it is desired that it be consumed.

When the contents of the bottle are to be enjoyed, the cork is removed from the opening in the neck of the bottle, such as utilizing a corkscrew type tool. The cork removal process is typically preceded by the step of removing a foil over-wrapping which is typically provided over the neck of the bottle and overlying the cork. This foil can act as a tamper proof "seal" of the manufacturer, so that the consumer has confidence that the wine bottle has not been opened. Upon removal of the cork, the consumer typically discards the cork or places the cork on a table or other horizontal surface for use in closing the opening of the bottle, should the contents of the bottle not be entirely used. The foil is typically discarded.

After the wine has been enjoyed, the bottle is discarded. Thus, at the end of this process three separate items are being discarded, which are typically made of different materials, including the metal foil over-wrapping, the cork of natural or synthetic materials and the glass bottle. A label is also typically on the bottle which is usually formed of a paper material, typically held in place by a glue adhesive between the bottle and a rear side of the label. To fully recycle all of these elements of the wine bottle, since they have different materials, can involve up to five different recycling procedures. At best, a consumer would separate the foil, cork, wine bottle, label from each other for recycling. However, the glue adhesive will remain on the bottle and typically at least some paper residue will remain adhering to the glue on the bottle as well. Thus, even in the best circumstances, full recycling is typically not achieved. More often, the bottle is recycled along with the label and the cork and foil are discarded and end up in a landfill were they undergo an exceptionally long process of breaking down into original constituents.

While the bottle comprises a largest portion of the overall wine bottle assembly, and recycling of the wine bottle is better than discarding it, wine bottle recycling is not a highly sustainable practice. First, the label typically needs to be removed so that the label can be discarded or recycled separately into paper goods. Adhesive can be exceptionally difficult to fully remove, unless utilizing harsh chemicals and/or high heat, which both have a cost in energy and non-sustainable consequences associated therewith. Thereafter, the glass of the bottle is typically crushed so that it can be feedstock into a bottle manufacturing process.

In glass manufacture suing crushed glass, at least the material is largely recovered, especially if the color of the glass is already appropriate, significant energy is utilized in crushing the glass and then heating the glass back into a molten state, and utilization of labor and/or automation equipment for making the glass into a new bottle. The energy utilized in this process must come from some source. Most energy sources are not sustainable. Even if sustainable energy sources are utilized, an overall capacity of sustainable energy resources are taxed significantly when glass bottles are being crushed and reformed to new bottles. This analysis has not even delved into the costs and burdens on sustainable systems associated with manufacture of glass crushing machinery and glass melting and bottle manufacturing equipment.

Consumers appreciate enjoying a thoughtfully constructed beverage which has both quality and taste as well as thoughtful packaging which minimizes burdens on the environment. When a quality product is packaged and delivered to consumers in a manner which is not particularly sustainable, either from an economic standpoint or from an energy and materials utilization standpoint, the informed and thoughtful consumer experiences diminished enjoyment, as the consumer contemplates the burden on planetary ecosystems which can be attributed to the consumer's decision to purchase and enjoy the beverage. Accordingly, a need exists for a wine bottle and wine bottle re-use system which is more effective in recycling and re-use in a manner minimizing ecosystem burdens to the greatest extent possible and achieving the greatest sustainability.

SUMMARY OF THE INVENTION

With this invention, a wine bottle and sustainable re-use system are provided. The wine bottle includes many basic features which are common to other known prior art wine bottles, including a hollow body terminating at an upper end through a shoulder transitioning into a neck. An opening passes into the neck and provides access into an interior of the bottle. A heel at the lower end of the body defines a lower end of the body. Inboard of the heel, a punt is provided, extending up above the heel and inboard of the heel, but still on an exterior of the bottle. The bottle of this invention is modified to include a cork retainer within the punt. Furthermore, in at least some embodiments, a unique exterior shape of the body is provided.

The cork retainer is configured to allow the cork to be held within the punt after it has been removed from the neck of the bottle and closing the opening. This cork retainer provides a location which is relatively sanitary and can allow for the cork to be held until it might be re-used closing the opening. After the bottle has been entirely emptied, the cork can remain with the cork retainer to allow for recycling/re-use of the cork along with the bottle at a facility optimally configured for such recycling/re-use. Furthermore, foil removed from surrounding the cork at the neck of the bottle, can be retained above the cork and within the punt so that the foil can also be returned to a processing facility along with the cork and bottle for recycling/re-use.

In a disclosed embodiment, the cork retainer is in the form of two retainer surfaces opposing each other within the punt. These retainer surfaces are preferably similar in size and shape and located a similar distance above the heel. These retainer surfaces are spaced apart by a distance similar to a length of the cork (or width/diameter). These retainer surfaces are sized with a width similar to a diameter of the cork, so that the cork fits snugly between these two retainer surfaces. Because the punt typically tapers as it extends upwardly to an apex, defining an uppermost portion of the punt, the retainer surfaces, being generally parallel with each other, extend into this tapering side of the punt, with the greatest depth of these retainer surfaces being at upper portion defined by a vault, which is preferably a curving semi-cylindrical surface against which the cork abuts when the cork has been placed up into the cork retainer and against the retainer surfaces as high as possible.

A curvature of this vault can match a radius of curvature of the cork in one embodiment, for a most secure holding of the cork in a desired position between the two retainer surfaces. A lower edge of each retainer surface is preferably open defining a lower portion of each retainer surface, so that it is easy to have the cork slide up into the cork retainer, with ends of the cork abutting against the retainer surfaces. These retainer surfaces can taper slightly if desired, so they are not perfectly vertical and not perfectly parallel with each other, and with upper portions that are slightly closer to each other than lower portions thereof. In this way, as the cork moves up into the cork retainer, the cork becomes more and more tightly held within the cork retainer. Such a slight tapering also facilitates manufacture of the cork retainer, as the cork retainer surfaces can be formed by molding and slide out of a mold in a vertical direction more readily, with such a slight taper. As an alternative, retainer surfaces could be perfectly parallel with each other and could still be molded provided the mold can accommodate such parallel vertical surfaces, or the retainer surfaces of the cork retainer could be formed by machining or other techniques.

The cork typically is a generally cylindrical structure with opposing ends of similar circular size and shape, and with a length of the cork defined as a distance between these two circular ends. The cylindrical sidewall of the cork typically has a substantially constant diameter, but can be slightly fatter as the cork extends toward a midpoint between the ends, to facilitate insertion of the cork but still provide a proper fraction fit within the opening of the bottle. If desired, the cork can be oversized at an upper end thereof, but most preferably the cork has ends of similar size both to allow for reversibility of the cork, and also to facilitate fitting of the cork within the cork retainer in a bottle of this invention, in either orientation.

In the disclosed embodiment, the body of the bottle has an upper region, a lower region and a label region between the upper region and the lower region. The label region is cylindrical in form. The upper region and lower region are preferably octagonal in horizontal cross-section and similar to each other. The label region has a slightly smaller width than the upper region and lower region, so that a label can be held within the label region by an upper transition and lower transition, where the label region transitions into the upper region or the lower region, without requiring adhesive to hold the label directly onto a surface of the bottle.

A package is provided for shipping of multiple similar wine bottles according to this invention. This packaging can have a variety of different numbers of columns and rows of one or more cells, with each cell holding one bottle therein. The packaging has outer walls defining a perimeter of the package and dividers inboard of the outer walls which divide the cells from each other. Each cell preferably has a square cross-section and a bottle fits snugly within the cell, so that four of the eight sides of the octagonal cross-section of the body abut the four sides of the cell. In such a configuration, at least one facet/side of the body is directly adjacent to at least one facet/side of another body of another bottle, except for a divider in between.

With such a configuration, should the package be jostled or dropped, or otherwise encounter relatively high forces acting laterally between the bottles, these forces would be applied to surfaces rather than points or lines on the bottle. Thus the propensity for damage to the bottles is greatly diminished. Glass bottles in the prior art, typically being cylindrical in form, have a line of contact when placed next to each other. Forces can concentrate to a high level when two such bottles bump into each other. The glass becomes scuffed and modified in appearance (or can break). If the bottle is recycled, such minor damage is of little consequence. However, by transmitting loads between bottles along surfaces, and minimizing damage thereto, the bottles are able to be cleaned, refilled and re-used without requiring recycling and the associated energy involved.

The cork and foil can remain within the cork retainer during the process of shipping multiple bottles back to a winery or other processing center. The winery can wash and re-use the wine bottle with a new cork, while the old cork and foil can be most efficiently recycled with other corks/ foils. Similarly, the label can be slid off of the bottle and recycled. A new label can be placed upon the refilled bottle and new foil can be placed over the bottle and a bottle paired with other bottles and placed within the packaging in which it was returned, for shipping back to the same consumer or a new consumer. The process can then be repeated. By allowing the bottles to be used multiple times with just washing and refilling between uses, and by allowing the packaging to be re-used, none of the energy associated with crushing used bottles and remaking of bottles from molten glass needs to be exerted. A highly sustainable bottle re-use process is thus provided.

OBJECTS OF THE INVENTION

Accordingly, a primary object of the present invention is to provide a wine bottle which has a cork retainer within a punt of the wine bottle.

Another object of the present invention is to provide a wine bottle which is configured and optimized for re-use.

Another object to the present invention is to supply wine or other beverages contained within bottles in a way which is highly sustainable, with a minimal energy footprint and materials utilization footprint.

Another object of the present invention is to provide a method for delivery, return and re-use of wine bottles.

Another object of the present mention is to provide a wine bottle which has a label which is easy to remove, without requiring adhesive adhering to the bottle itself.

Another object of the present invention is to provide a wine bottle which is shaped to avoid scuffing or other damage when the bottle comes into contact with other similar bottles.

Another object of the present invention is to provide a system and method for holding a cork when it is not in use, so that it is ready to be re-used in closing an opening into a bottle, if not all of the contents of the bottle are used at one time.

Another object of the present invention is to provide a system and method for storing both a cork and foil of a beverage bottle after they have been removed from an opening on a neck of the bottle, to best facilitate re-use and/or recycling of the bottle, cork and/or foil (as well as the label).

Other further objects of the present invention will become apparent from a careful reading of the included drawing figures, the claims and detailed description of the invention.

BRIEF DESCRIPTION OF THE DRAWING FIGURES

DETAILED DESCRIPTION OF THE PREFERRED EMBODIMENT

Figure 1:
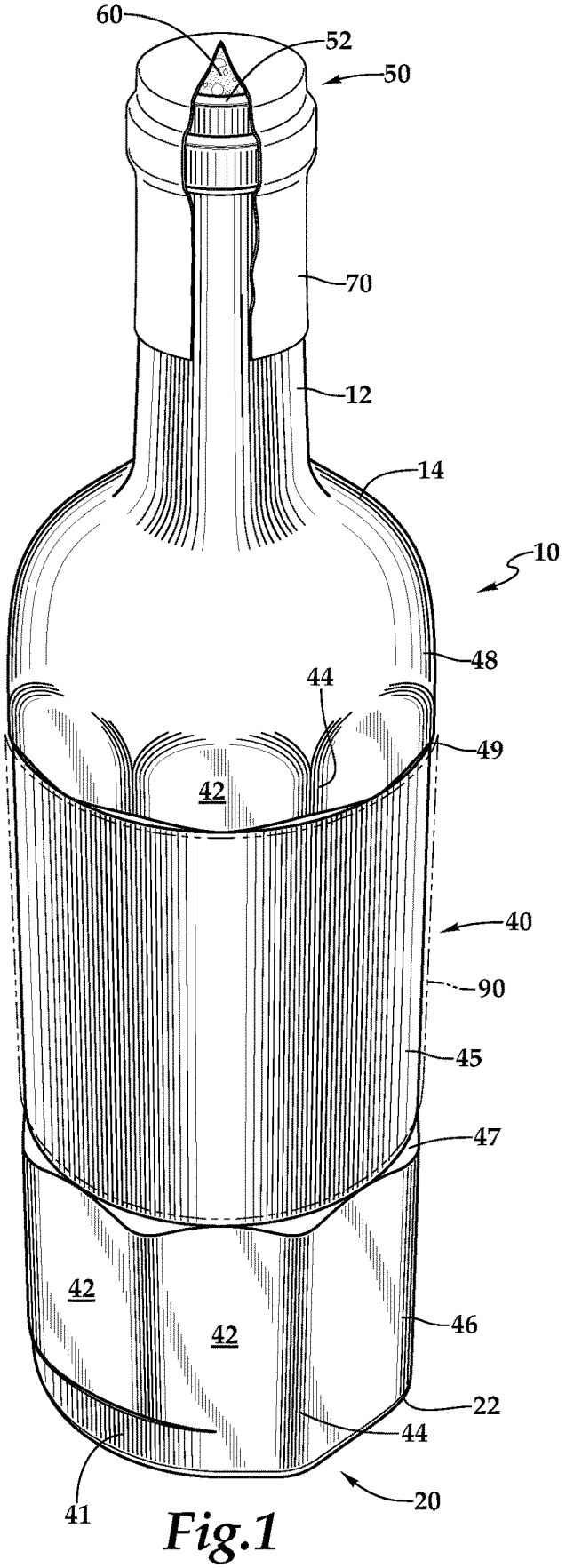
FIG. 1 is a perspective view from above of a wine bottle configured according to this invention in an example embodiment.

Referring to the drawings, wherein like reference numerals represent like parts throughout the various drawing figures, reference numeral 10 is directed to a bottle featuring a cork retainer (FIGS. 1 and 3-5), and usable within a re-use method (FIG. 2) to maximize sustainability and minimize waste and unnecessary burdens in the delivery and consumption of wine and other beverages.

Figure 2:
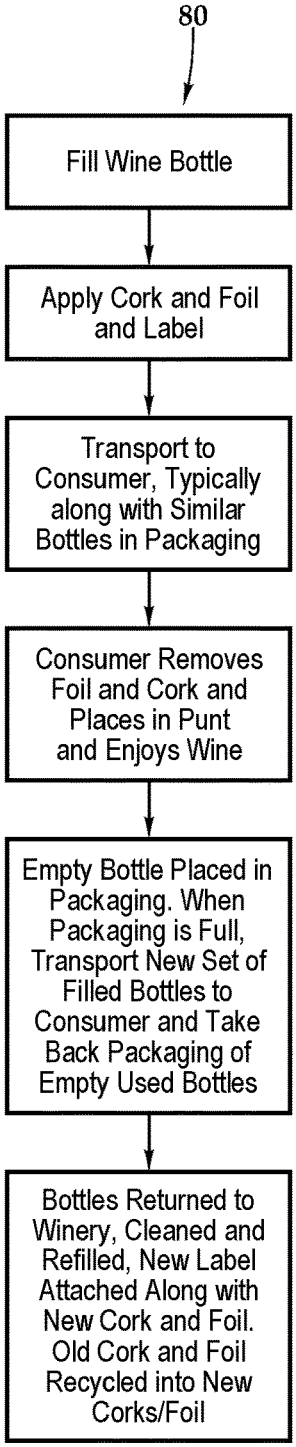
FIG. 2 is a flow chart identifying steps in a system of use and re-use of a wine bottle, such as that which is depicted in FIG. 1.
Figures 3, 4, 5:
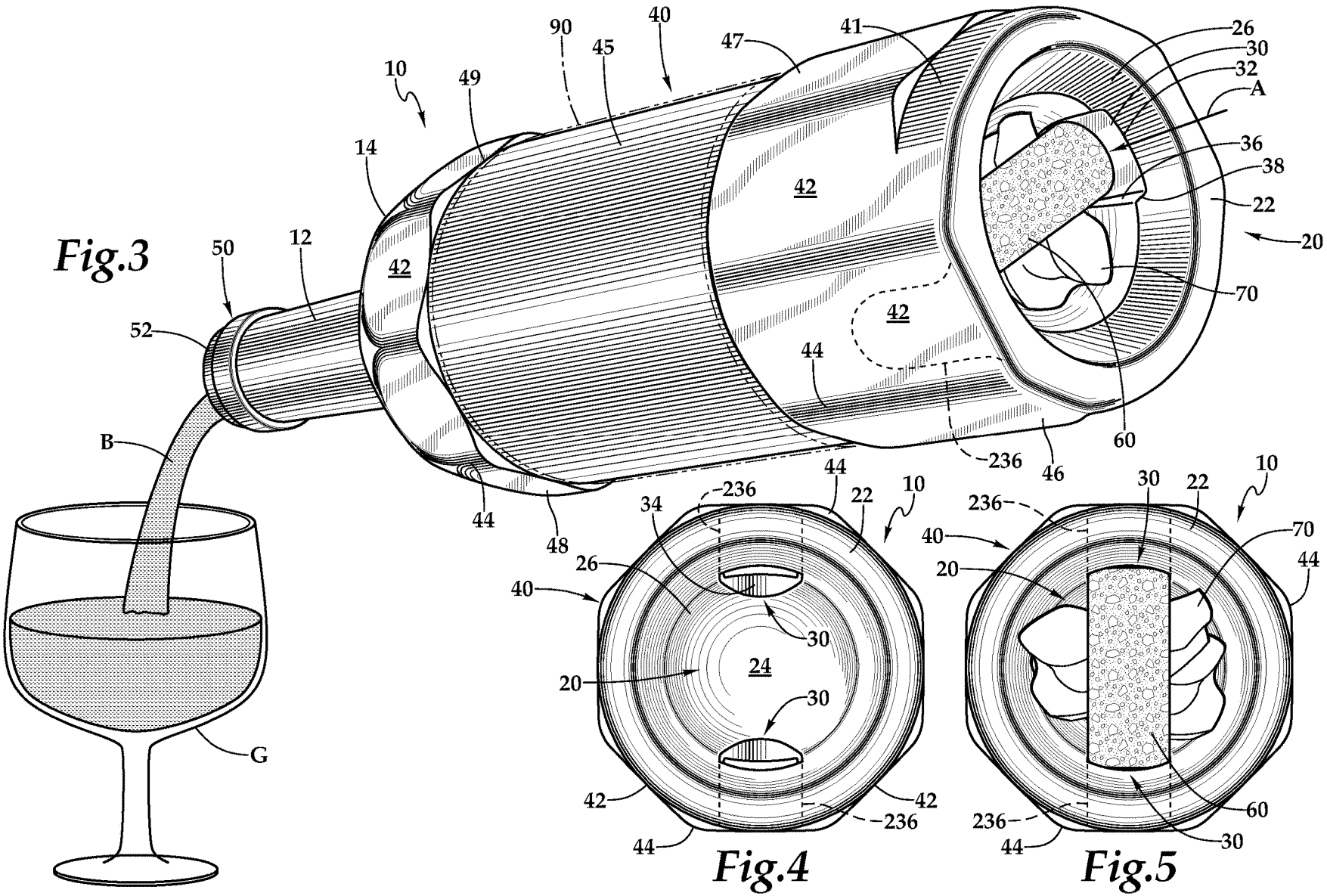
FIG. 3 is a perspective view of the wine bottle of FIG. 1 in use pouring wine from the bottle (or other beverages), and with a cork retainer holding a cork and foil within a punt of the bottle, according to this invention.
FIG. 4 is a bottom plan view of the bottle of FIG. 1 and showing a cork retainer within the punt, without a cork therein.
FIG. 5 is a bottom plan view similar to that which is shown in FIG. 4, but with a cork and foil held therein.
Figure 6:
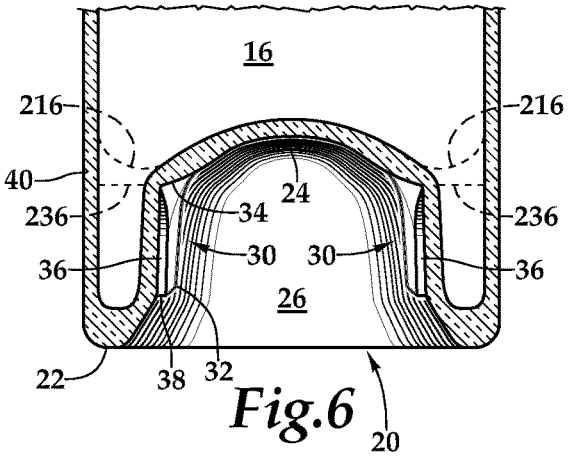
FIG. 6 is a front elevation full section of view of a lower portion of the bottle of FIG. 1 and showing the cork retainer within the punt of the bottle.
Figure 7:
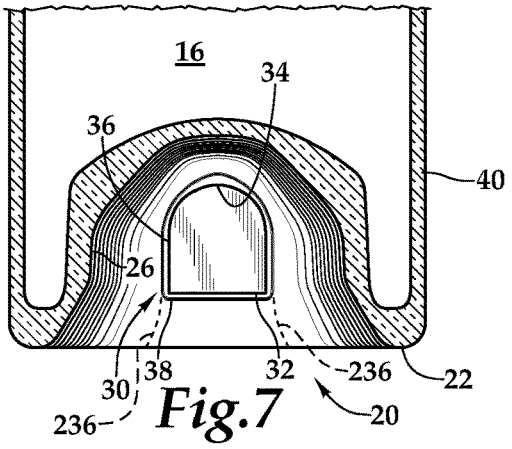
FIG. 7 is a side elevation full sectional view of a lower portion of the bottle of FIG. 1 and showing the cork retainer within the punt of the bottle.
Figure 8:
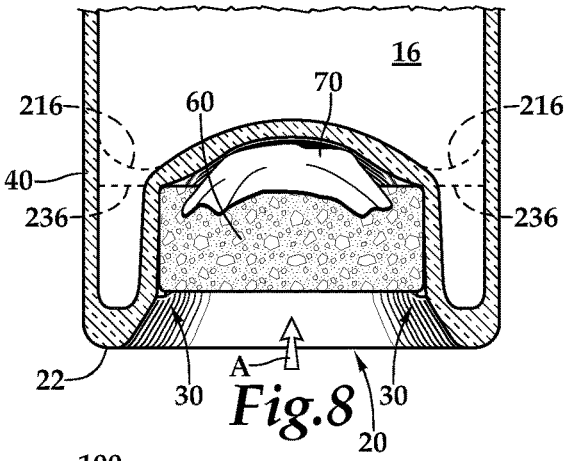
FIG. 8 is a sectional view similar to that which is shown in FIG. 6, but with a cork and foil stored within the punt of the bottle.
Figure 9:
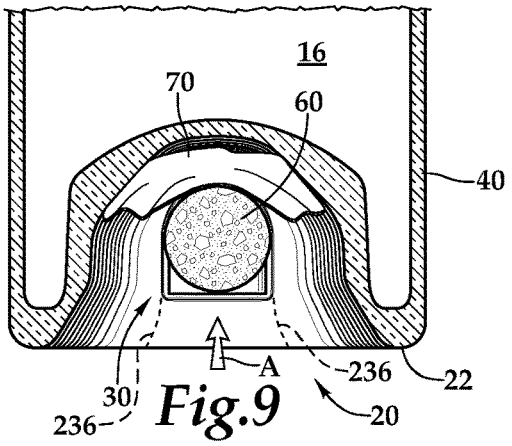
FIG. 9 is a sectional view similar to that which is shown in FIG. 7, but with a cork and foil shown within the punt of the bottle.

In essence, and with particular reference to FIGS. 1 and 3, basic details of the bottle 10 and associated cork retainer are described, according to one example. The bottle 10 generally includes a neck 12 at an upper end thereof and a punt 20 at a lower end of a body 40 of the bottle 10. Retainer surfaces 30 are located within the punt 20 and are spaced from each other and oriented to allow a cork 60 to fit frictionally between these retainer surfaces 30, such as after the cork 60 has been removed from an opening at a top of the neck 12 of the bottle 10. A finish 50, 150 of the bottle 10 can in one embodiment support an O-ring 155 having a liquid absorbent character. The O-ring 155 can keep a drip D from falling down onto the body 40 of the bottle 10 after the beverage B has been poured at least partially from the bottle 10. Foil 70, overlying the cork 60 after cork 60 removal, can also be stored within the punt 20 and above the cork 60 when the cork 60 is wedged between the retainer surfaces 30 of the cork retainer within the punt 20.

More specifically, and with initial reference to FIGS. 1 and 3, basic details of the bottle 10 are described, according to one illustrated embodiment. The bottle 10 is an elongate hollow structure formed of glass surrounding an interior 16 (FIGS. 6-9). The bottle 10 can have any of a variety of different sizes, but would typically be a standard wine bottle size, such as 750 mL. The bottle 10 includes a neck 12 at an upper portion thereof extending from a shoulder 14 above a body 40 to a finish 50, defining an upper end of the neck 12.

The neck 12 includes an outer wall which typically tapers somewhat from the shoulder 14 to the finish 50. A lip 52 on the finish 50 defines a perimeter of an opening extending into the interior 16 of the bottle 10. This opening inboard of the lip 52 supports a cork 60 therein, when the bottle 10 is sealed at the winery or other filling location. Typically, the bottle 10 is substantially radially symmetrical and elongate in form with a height three or more times greater than a width.

A body 40 of the bottle 10 is located below the shoulder 14. This body 40 is generally cylindrical in form and outboard of a main compartment of the interior 16 of the bottle 10, where a majority of the wine or other beverage B is located when stored within the bottle 10. The bottle 40 has an outer surface which generally supports an area where a label can be placed, also known as a label region 45. Details of the particular body 40 according to one embodiment of this invention are described in detail below.

A lower end of the body 40 terminates at a heel 22 defining a lowermost portion of the bottle 10. The heel 22 defines a portion of the bottle 10 which can rest upon an underlying surface, such as a tabletop. The heel 22 defines a lowermost portion and perimeter of a punt 20. The punt 20 is a concave structure extending up into an area inboard of outer walls of the body 40, at least somewhat. This recess of the punt 20 terminates at an apex 24 defining an upper end of the punt 20. Tapering sides 26 extend from the heel 22 to the apex 24. Typically these tapering sides 26 are substantially radially symmetrical. Various different bottles 10 have punts 20 of different sizes. The punt 20 generally has a volume which is subtracted from interior space inboard of the body 40 of the bottle 10, along with wall thicknesses, to arrive at a volume of the bottle 10 interior 16 (along with a volume contained within portions of the bottle 10 inboard of the shoulder 14 and neck 12 of the bottle 10).

With particular reference to FIGS. 3-9, details of a retainer within the punt 20, for holding the cork 60 therein, are described, according to one example embodiment. The punt 20 in the bottle 10 of this invention is modified from prior art punts 20 to include a retainer therein for holding a cork 60 with the punt 20. This retainer primarily is formed of retainer surfaces 30 formed in the tapering sides 26 of the punt 20. These retainer surfaces 30 are preferably similar to each other in size and shape, and oriented parallel to each other and facing each other. A spacing between these retainer surfaces 30 is preferably similar to a length of the cork 60 between ends of the cork 60. Each retainer surface 30 has a size and width similar to a width of the cork 60, generally defined by a diameter of a cylindrical sidewall of the cork 60, which extends between the ends of the cork 60.

As an alternative, the retainer surfaces 30 could be spaced apart by a width of the cork 60 rather than its length. As an option, the retainer surfaces 30 (or at least one of them) could be eliminated. In its place, the punt 20 could extend laterally (along a centerline of the cork 60) to an exterior of the body 40 of the bottle 10. The cork 60 could be seen in this embodiment, at least one end thereof. Such an alternate retainer surface 236 is shown in broken lines in FIGS. 3-9. The interior 216 could be modified correspondingly, as also shown in broken lines. Such an alternative allows the cork 60 to be seen and also facilitates larger corks 60 and/or smaller bottles.

Each retainer surface 30 preferably includes a lower edge 32 which fades into lower portions of the tapering sides 26 of the punt 20, just above the heel 22. Ends of the cork 60 can thus readily slide up into the punt 20 and over the lower edge 32 to come into a friction fit adjacent to each of the retainer surfaces 30. An upper portion of the retainer surfaces 30, opposite the lower edge 32 is defined by a vault 34. This vault 34 is preferably a curving structure with a radius of curvature similar to a radius of curvature of the cylindrical sidewall of the cork 60 adjacent to the ends of the cork 60. In this way, the cork 60 can slide up, wedged between the retainer surfaces 30, until the ends of the cork 60 about the vault 34 along an entire surface of the vault 34.

Sidewalls 36 of each retainer surface 30 extend from the vault 34 down to a foot 38 adjacent to the lower edge 32. The sidewalls 36 are perpendicular to the retainer surfaces 30 and extend within substantially vertical planes which are parallel and spaced from each other for each of the retainer surfaces 30. The sidewalls 36 act as guide abutments, keeping the ends of the cork 60 aligned within a center of the retainer and a center of the retainer surfaces 30, as the cork 60 moves upward into the retainer. While the sidewalls 36 can be parallel with each other, in one embodiment, the sidewalls 36 are slightly further from each other adjacent to the foot 38 than adjacent to the vault 34, to assist in ensuring the cork 60 is guided into the retainer, but still leaving the end of the cork 60 fully supported once the cork 60 has been inserted (along arrow A of FIGS. 3, 8 and 9) up into the retainer and abutting the vault 34.

While the retainer surfaces 30 are preferably substantially parallel with each other, the retainer surfaces 30 can be slightly further from each other at the lower edges 32 thereof than at the vault 34 thereof. In this way, the cork 60 initially readily fits into lower portions of each retainer surface 30, but then the cork 60 becomes more and more tightly held within the retainer as the cork 60 is moved upward (along arrow A) toward the vault 34, for secure holding of the cork 60. Most preferably, this spacing between the retainer surfaces 30, at least adjacent to the vault 34, is slightly less than a length between ends of the cork 60, so a friction fit is provided, holding the cork 60 securely within the retainer and abutting each of the retainer surfaces 30.

The retainer surfaces 30 are sufficiently far up into the punt 20, that the cork 60 is entirely above the heel 22 when placed within the retainer of the punt 20. The retainer surfaces 30 are sufficiently low within the punt 20 to leave space above the retainer surfaces 30 of the retainer and below the apex 24 of the punt 20. This space above the retainer can support the foil 70, pinched between the apex 24 and the cork 60, so that the foil 70 does not need to be thrown away or recycled by a user of the bottle 10, but rather can be returned, along with the cork 60 and the bottle 10, either for re-use or recycling in a most efficient manner along with other similar foils of other bottles at a centralized return location.

The retainer surfaces 30 can be formed by casting, such as along with casting of the entire bottle, or can be formed by machining, such as in a separate procedure performed after the bottle is formed. Other forms of manufacture of the retainer surfaces 30, could include formation by additive manufacturing, where surface portions of the punt 20 would be built up in an additive manufacturing process, and leaving out space for the retainer surfaces 30, to provide the retainer function of this invention. While the retainer surfaces 30 are disclosed in this embodiment as recesses extending into material forming the bottle 10, it is conceivable that the retainer surfaces 30 could instead be built out of adjacent surface portions of the bottle 10 within the punt 20, or the retainer surfaces 30 could be a combination of cut into a surface of the bottle and extending out of a surface of the bottle within the punt 20. The retainer surfaces could optionally be curved cylindrically (about a vertical central axis), if configured to hold the cork 60 between sides of the cork 60 rather than the ends.

With particular reference to FIGS. 1 and 3-5, particular details of the body 40 are described in one embodiment of this invention. While the bodies of bottles 10, such as wine bottles, are typically cylindrical in form, an embodiment of the body 40 disclosed herein is faceted to have an outer contour which is octagonal in cross-sectional form (when viewed with a horizontal cross-section). The body 40 preferably has three regions including a label region 45 at a middle elevation of the body 40, and with a lower region 46 below the label region 45 and an upper region 48 above the label region 45. The lower region 46 extends from the label region 45 down to the heel 22 of the bottle 10. The upper region 48 extends from the label region 45 up to the shoulder 14. The label region 45 extends between the lower region 46 and upper region 48. A lower transition 47 is located between the lower region 46 and the label region 45. An upper transition 49 is located between the label region 45 and the upper region 48.

In this embodiment, the label region 45 is substantially perfectly cylindrical in form, having a constant width which is slightly less than an average width of the upper region 48 and lower region 46. In this way, a label can be placed over the label region 45, with the label 90 (FIG. 3) held in place by the lower transition 47 and upper transition 49, and not requiring adhesive to hold directly to the bottle. In this way, when the bottle 10 is re-used, no adhesive needs to be removed or otherwise factored into such re-use.

In one embodiment, the label 90 can be a band of material which is slightly stretchable and formed without a seam. Such a label 90 can slide over the lower region 46 or the upper region 48 and resiliently return to an original diameter to tightly fit over the label region 45. In another embodiment, the label 90 includes at least portions thereof which can be caused to shrink after placement of the label 90 adjacent to the label region 45. For instance, the label could be formed of at least partially plastic hydrocarbon material which has a shrinking characteristic when heat is applied. Such a label can first be placed loosely over the label region 45, and then can have heat applied until the label shrinks and tightly fits within the label region.

In another embodiment, the label 90 begins as a planer strip of paper and adhesive is used to bond one lateral edge of the label to an opposite lateral edge of the label. In such an arrangement, no adhesive is required between the bottle and the label 90, but rather adhesive is only provided between two portions of the label 90, and no adhesive needs to be removed from the bottle 90.

In another embodiment, an adhesive is utilized to hold the label 90 in place, at least partially, which adhesive is designed to be readily removable, such as by application of mild heat. In this way, a hot water and/or steam sterilizing process for the bottle 10 would readily remove any such adhesive which was previously used to hold the label 90 in place. Furthermore, any such label adhesive can be formed of a biodegradable and/or a naturally occurring substance, such that sustainability is maintained for the overall bottle 10 and label 90, and with little or no environmental impact associated with utilization of the adhesive.

The upper region 48 and lower region 46 are preferably faceted with eight facets 42 spaced from each other by corners 44. These corners 44 are preferably rounded, but still leave a majority of the outer surface of the body 40 located within the facets 42 of planar form. At the transitions 47, 49, the facets 42 and corners 44 transition gradually into the cylindrical form of the label region 45. At upper portions of the upper region 48 and lower portions of the lower region 46, the facets 42 and corners 44 transition into either the shoulder 14 for the upper region 48 or the heel 22 for the lower region 46. A band 41 is provided in one embodiment just above the heel 22 which is semi-cylindrical in form, and interrupting at least some of the facets adjacent to the heel 22, which band can allow for rotational alignment of the bottle 10 within automated bottle 10 handling equipment.

The octagonal body 40 outer surface, defining approximately half of an outer surface of the body 40 of the bottle 10 has a variety of benefits. The facets 42 and corners 44 can provide a somewhat more tactile surface for a user to more readily grasp the bottle 10 during use, and to diminish risk that the bottle 10 will slip out of a hand of a user. If the bottle 10 is laying on a horizontal surface, such as a tabletop, it is prevented from rolling, but rather will settle onto one of the facets 42. This can prevent the bottle 10, should it be placed on its side or fall onto a side, from rolling to an edge of a table and then falling to the floor, where it might potentially break, or cause an injury.

Figure 10:
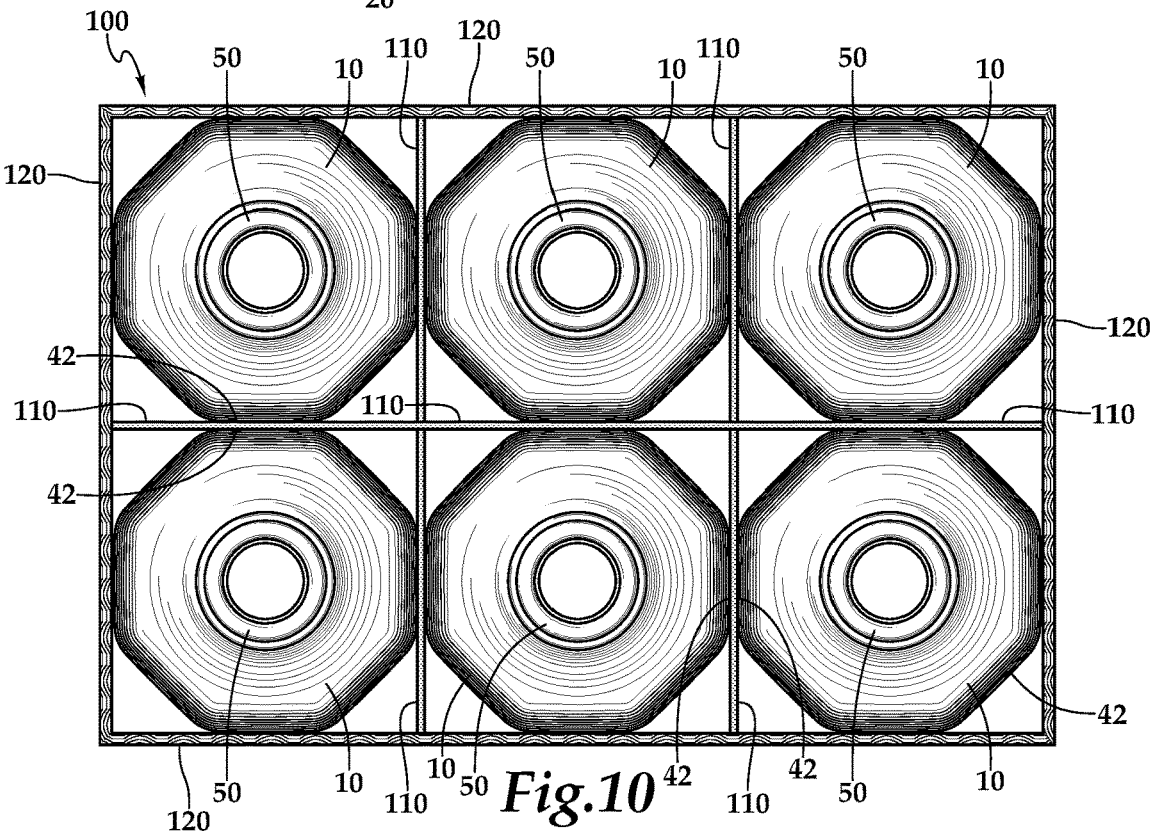
FIG. 10 is a top plan view of storage and/or shipping packaging for multiple bottles and with cells of the packaging space by dividers and with bottles within the cells and fitting snuggly with facets of the bottles adjacent to each other.
Figure 11:
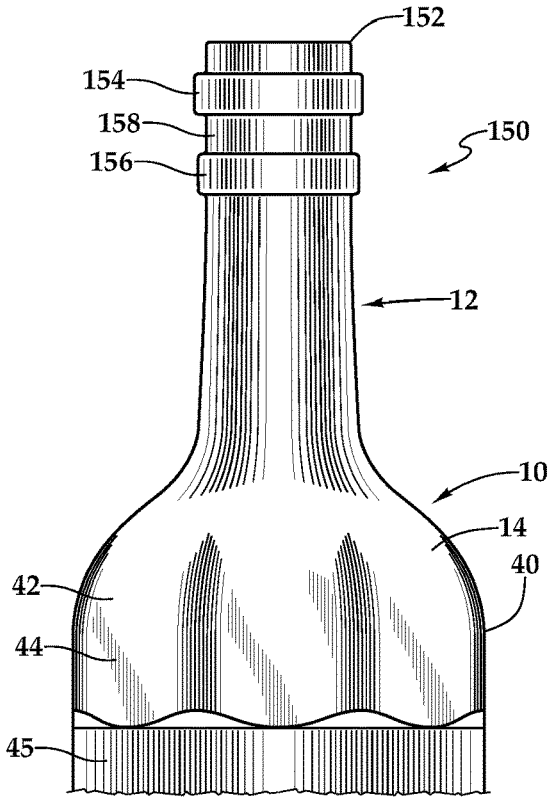
FIG. 11 is a detail of an upper portion of an alternative embodiment bottle featuring a drip collecting a groove between two collars, the groove for holding an absorbing O-ring near a lip of a finish of the bottle, and with the O-ring not shown.

Furthermore, and as depicted in FIG. 10, the bottle 10 can conveniently be transported and/or stored within packaging 100 which more safely carries a group of bottles 10 with limited packaging 100, compared to what would be the case with cylindrical bottles 10. In particular, the packaging 100 includes outer walls 120 with dividers 110 dividing the packaging 100 and separate cells. Each cell can hold one bottle 10 therein.

FIG. 10 depicts a top plan view of such packaging 100 with six cells and with one bottle within each of the six cells. In this embodiment, the cells are all square in horizontal cross-section. Facets 42 of each bottle 10 are aligned with each other so that half of the facets are parallel with and abutting either a portion of a divider 110 or a portion of the outer wall 120, in a parallel plane-to-plane abutting orientation. With respect to the dividers 110, facets 42 of bottles 10 are provided on either side of each divider 110 in a planar adjacent orientation.

One significant risk when transporting bottles within packaging is that the bottles 10 will slam together with sufficient force during transport, that the bottles will break. Cylindrical bottles, placed adjacent to each other, have forces there between concentrated along very exceptionally small areas on an exterior of the bottles. This leads to stress concentration and a heightened potential for breakage. Even if the bottles 10 do not break, these small abutting surfaces are highly likely to be scratched/etched in a manner which scuffs up the bottles and makes them less desirable in appearance. Such contact between bottles can also damage the labels placed on exteriors thereof. Consumers often have less of a preference for drinking wine from the bottle which is scuffed up or has a torn label or other wear visible on an exterior thereof.

Consumers of wine or other beverages from such a bottle are likely to wonder what other defects are associated with the lack of care which resulted in the bottle damage. To prevent this, excessive packaging 100 can be utilized, but has additional cost, weight for transport, and waste when the packaging 100 is disposed of. With this invention, the facets 42 of the multiple bottles 10 are brought adjacent to each other in a co-planar fashion, so that forces exchanged therebetween are spread out over the large surface area of the facets 42. A small divider 110, or even no divider can be provided and damage is avoided. Such avoidance of damage to the bottles 10 further facilitate re-use of the bottles 10, such as by cleaning and refilling thereof, a large number of times, without damage to the bottles 10.

The packaging 100, in various embodiments, could have beveled corners so that corner cells have one beveled corner and corner cells of the packaging 100 would be adjacent to facets 42 of the bottles 10 on at least one additional facet 42. As a further option, each exterior corner of the cells could be beveled to still further hold and support the bottles 10. In one embodiment, the packaging is flexible plastic which can be rolled up to fit within a cell of another package for return for re-use or recycling.

With particular reference to FIGS. 11-14, details of an alternative embodiment finish 150 for an upper end of the neck 12 of the bottle 10 as described. This alternative finish 150 supports an O-ring 155 which is of at least partially absorbent character, to catch a drip D which commonly attempts to roll down an exterior of the neck 12 of the bottle 10 (FIG. 13) after pouring a beverage B (FIG. 3). The finish 150 in this embodiment includes a lip 152 surrounding an opening into which the cork 60 is removed, before pouring wine or other beverage B from the bottle 10 (FIG. 3). The finish 150 includes an upper collar 154 and a lower collar 156 with a groove 158 between the upper collar 154 and lower collar 156. Each of these collars 154, 156 is cylindrical in form and the groove 158 is also cylindrical in form. The upper collar 154 preferably has a slightly larger diameter to help to hold the foil 70 (FIG. 1) and to hold the O-ring 155 within the groove 158. As an alternative, the collars 154, 156 could have the same diameter.

A cylindrical O-ring 155 fits within this groove 158 between the upper collar 154 and lower collar 156. While O-ring 155 is shown as having a cylindrical form, it could alternatively have a more toroidal form and still fit within groove 150 and function according to this invention. At a minimum, the O-ring 155 forms a circuit which can reside within a groove 158 of some shape between an upper collar 150 or a lower collar 156 which define raised portions of the finish 150 of the neck 12.

The O-ring 155 is preferably formed of a sufficiently resilient material that it can be snapped into place within the groove 158 and hold its position within this groove 158, after appropriate forces are applied to stretch O-ring 155 and move the O-ring over the upper collar 154. The O-ring 155 preferably has some absorbency characteristics, so that a drip D falling down the neck 12 of the bottle 10 (FIG. 13) is absorbed by the O-ring 155. In one embodiment, the O-ring 155 is sufficiently absorbent to catch a half dozen drips, so that the O-ring 155 is not saturated until the bottle 10 has been drained of wine or other beverage B. In one embodiment, the O-ring 155 primarily relies upon capillary action and the small space between the collars 154, 156, groove 158 and O-ring 155 to hold the liquid therein, rather than, or in addition to any absorbency of the material forming the O-ring 155.

Figure 12:
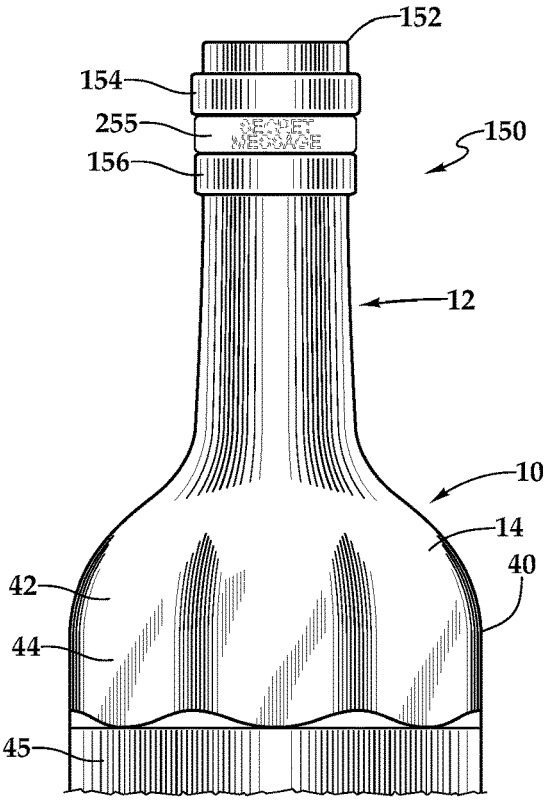
FIG. 12 is a detail similar to that which is shown in FIG. 11, but with an O-ring in place within the groove between the upper and lower collars.
Figure 13:
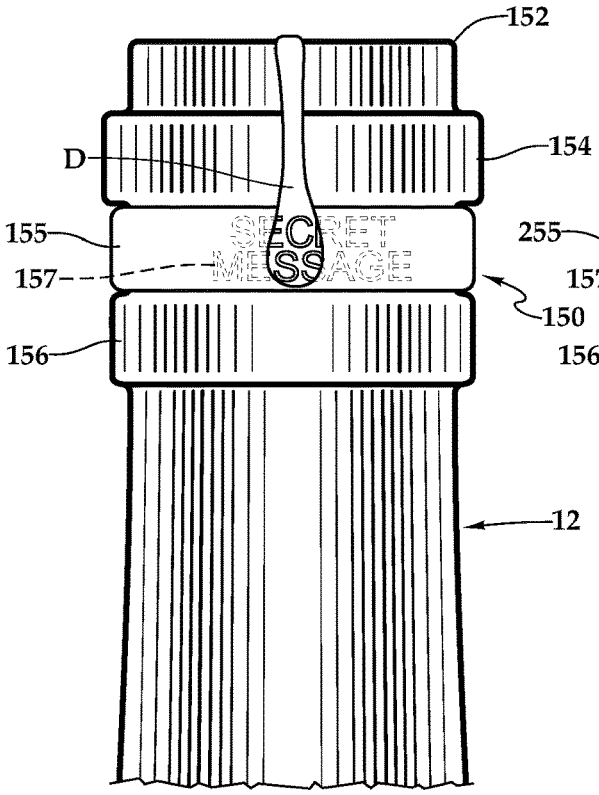
FIG. 13 is a close-up detail of that which is shown in FIG. 12, and with a drip of liquid being absorbed by the O-ring.
Figure 14:
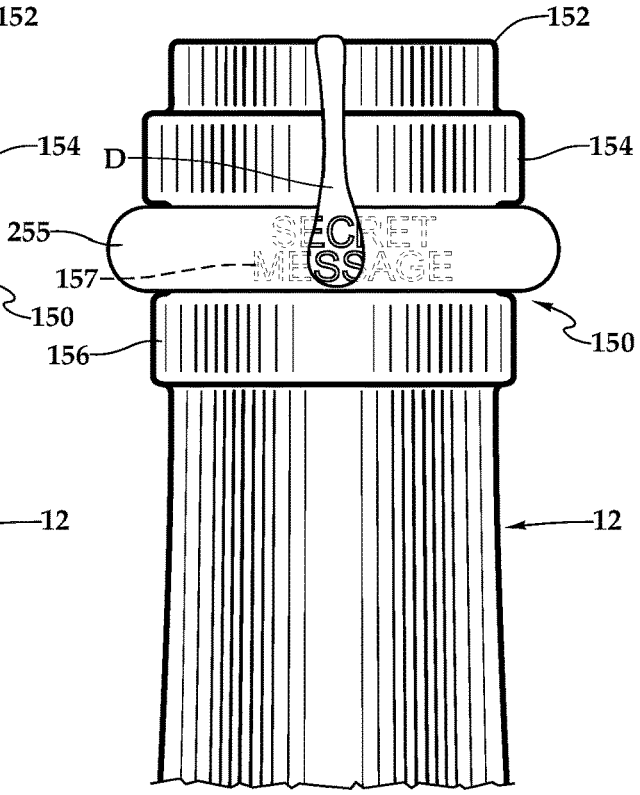
FIG. 14 is a close-up detail of that which is shown in FIG. 12, but with the O-ring being more toroidal rather than more cylindrical.

The O-ring 155 is shown in FIGS. 12 and 13 with a cylindrical form, mostly filling the groove 150. In FIG. 14 and alternative O-ring 255 has a toroidal form. With such a toroidal form, larger void space for holding "drips" could be provided.

In one embodiment, the O-ring 155 has an outer surface thereof printed with text 157. In one embodiment, this text 157 is in the form of hidden text, such as text printed out of lemon juice or some other material which is capable of being printed and which is generally invisible when dry. This hidden text 157 can be selected so that when it comes into contact with liquid of any type, or when it comes into contact with liquid of a particular type, such as wine, that the text transitions from being hidden to being visible. In this way, the hidden text 157 can have a message which is hidden until a drip D contacts the O-ring 155, causing the hidden text 157 to transition from being hidden text 157 to being visible text. Such a hidden text can, once revealed, provide another aspect of enjoyment to consumers of the wine or other beverage B contained with in the bottle 10.

In various embodiments, the secret text 157 could, rather than being text, merely be a decorative/ornamental pattern and/or design. As another alternative, the O-ring 155 could be formed of pH test material which exhibits a color corresponding with a pH level of the wine or other beverage constituting the drip D. In this way, analytical information would be conveyed to a consumer of the beverage B constituting the drip D.

In use and operation, the bottle 10 of this invention along with a cork 60 and foil 70 can be used and re-used according to a re-use method 80 (FIG. 2) which allows for a most sustainable overall methodology for enjoying wine or other bottle 10 contained beverages B. Initially, the wine bottle 10 is filled with wine, such as at a central filling location, which would typically be a winery. Either before or after filling the wine bottle, a label 90 is applied to the bottle 10. After filling of the bottle 10, a cork 60 is fitted on the bottle 10 to close an interior of the bottle 10. Foil 70 is typically provided over the cork 60. While wine bottles 10 could be delivered in various different quantities to consumers in various different ways, according to one embodiment of this invention, multiple bottles 10 are placed within packaging 100, such as that depicted in FIG. 10 and described in detail above. The shipping container is sent to a consumer. The consumer can keep the wine bottles 10 within this packaging 100 if desired, or can keep the packaging 100 as a receptacle for the bottles 10 after they have been emptied, such as for consumption of the wine or other beverage B within the bottles 10 (FIG. 3).

A goal of the re-use method of this invention is to reduce to zero (or near zero) the waste associated with enjoying wine or other beverage B from the bottle 10. To keep the cork 60 and foil 70 from becoming waste products, and to provide a convenient location for placement of the cork 60 after it is removed from the neck 12 of the bottle 10, a consumer removes the foil and cork from the neck 12 of the bottle 10 and places the cork within the retainer in the punt 20 of the bottle 10, with the foil 70 folded up and trapped above the cork 60. The wine or other beverage B can then be poured from the bottle 10, into a glass G or other drinking article, for enjoying of the beverage B (FIG. 3). After the bottle 10 is empty, the bottle 10 can be returned to one of the cells of the packaging 100. When the packaging 100 is full of bottles 10, this packaging 100 can be used to transport the load of bottles 10 back to the winery or other filling location, or other re-use location.

In one embodiment, and for maximum sustainability and efficiency, a delivery service is provided which transports a new order of wine bottles 10 in a new package 100 to the consumer, and when arriving at the consumer location, picks up packaging 100 full of empty bottles 10. In this way, transportation personnel are beneficially only utilizing transportation resources to carry useful loads in both directions, rather than having extra trips where nothing beneficial is being carried.

Because of the unique shape of the bottles 10, as described above, the packaging 100 has a minimal amount of material associated therewith and avoids scuffing or other damage. At the winery or other re-use location, the bottles 10 are removed from the packaging 100. Corks are removed from the retainers in the punts 20 of the bottles 10 and the corks 60 can be recycled together in a most efficient manner. In one embodiment, this would involve grinding up of the cork material and utilization of the ground up cork material in formation of new synthetic corks. In another embodiment, such as if the cork is a natural material, it can be converted into articles from which recycled cork can be made, or can be disposed of, due to its biodegradable natural nature, in a sustainable manner. The foil 70 can similarly be repurposed or recycled along with other foil 74, maximizing efficiency in such recycling. Furthermore, the labels 90 can be removed from the bottles and recycled or responsibly disposed of or re-purposed.

The bottle 10 can be thoroughly cleaned utilizing a variety of different processes, and does not need to be crushed and reconstituted into a new bottle 10, but rather can readily be refilled after appropriate cleaning/sterilization has occurred. The filled bottle 10 can have a new label 90 placed thereon and a new cork 60 and foil 70 applied thereto. When the wine or other beverage B is ready and a consumer is identified, the refilled bottle 10 of a re-used nature can be shipped back to a consumer (or retail establishment) to repeat the process. While a retail consumer is described above, an intermediate retail store, or restaurant or other location could similarly function as the consumer or as an intermediary between the winery and the consumer.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When embodiments are referred to as "exemplary" or "preferred" this term is meant to indicate one example of the invention, and does not exclude other possible embodiments. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A wine container, comprising in combination:

a bottle;

a cork;

said bottle including a neck above a body, with a shoulder between said neck and said body;

an opening at an upper end of said neck, said opening leading into an interior of said bottle;

said opening sized to receive said cork therein, in a manner closing off said opening;

said bottle including a heel at a lower end of said body;

said bottle including a punt extending up from said heel and defining a lower portion of said bottle inboard of said heel;

said punt having an apex at a highest portion of said punt, and with sides extending down from said apex to said heel;

said cork having ends spaced apart by a side wall, said cork side wall sized to fit within said opening of said neck in a removable fashion;

a cork retainer at least partially within said punt and configured to hold said cork within said punt after said cork is removed from said opening;

wherein said cork retainer includes at least two opposing surfaces spaced from each other by a distance similar to said ends of said cork;

wherein said at least two opposing surfaces are spaced from each other by a cork length between said ends of said cork; and wherein said cork retainer includes a lower edge at a lower portion of each of said at least two opposing surfaces, each of said at least two opposing surfaces including a vault above said lower edge, said vault having a curvature matching a curvature of said ends of said cork.

2. The wine container of claim 1 wherein said at least two opposing surfaces are each spaced a similar distance above said heel.

3. The wine container of claim 2 wherein said at least two opposing surfaces are spaced a similar distance below said apex of said punt and located within tapering sides of said punt between said heel and said apex.

4. The wine container of claim 1 wherein said container includes foil over wrapping said cork and at least portions of said neck of said bottle, said foil removable from said bottle, and a foil space within said punt and above said cork retainer, said cork sized to friction fit between said at least two opposing surfaces, with said foil space large enough to hold said foil within said foil space when said foil is removed from said neck of said bottle.

5. The wine container of claim 1 wherein said body of said bottle includes at least portions thereof which have a horizontal cross-section which is octagonal with eight planar facets spaced apart by corners.

6. The wine container of claim 5 wherein said body of said bottle includes an upper region, a lower region below said upper region and a cylindrical label space between said upper region and said lower region.

7. The wine container of claim 6 wherein said upper region and said lower region of said body of said bottle each have an octagonal horizontal cross-section which are similar to each other.

8. The wine container of claim 5 wherein said planar facets of said body of said bottle are each divided by a cylindrical label space.

* * * * *